US008116642B2

(12) United States Patent
Teramura

(10) Patent No.: US 8,116,642 B2
(45) Date of Patent: Feb. 14, 2012

(54) DEVELOPER STIRRING UNIT, DEVELOPING DEVICE AND IMAGE FORMING APPARATUS

(75) Inventor: Osamu Teramura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 450 days.

(21) Appl. No.: 12/363,038

(22) Filed: Jan. 30, 2009

(65) Prior Publication Data

US 2009/0190938 A1 Jul. 30, 2009

(30) Foreign Application Priority Data

Jan. 30, 2008 (JP) ..... 2008-018981

(51) Int. Cl.
*G03G 15/08* (2006.01)

(52) U.S. Cl. ..... 399/27; 399/61; 399/119; 399/254

(58) Field of Classification Search ..... 399/27, 399/61, 119, 254
See application file for complete search history.

(56) References Cited

U.S. PATENT DOCUMENTS

| | | | | |
|---|---|---|---|---|
| 5,134,441 | A * | 7/1992 | Nagata et al. | 399/254 |
| 2007/0092305 | A1 * | 4/2007 | Daigo et al. | 399/263 |

FOREIGN PATENT DOCUMENTS

| | | | |
|---|---|---|---|
| JP | 09-054488 | A | 2/1997 |
| JP | 09236981 | A | 9/1997 |
| JP | 2000181207 | A | 6/2000 |
| JP | 2001166566 | A | 6/2001 |

* cited by examiner

*Primary Examiner* — Ryan Walsh
(74) *Attorney, Agent, or Firm* — Panitch Schwarze Belisario & Nadel LLP

(57) ABSTRACT

A developer stirring unit, a developing device containing the developer stirring unit and an image forming apparatus comprising the developing device are supplied capable of correctly judging a remainder amount of developer in accommodating tank. In the developer stirring unit, a accommodating tank accommodates developer; a stirring member has at least one shaft portion and is used to stir the developer accommodated in the accommodating tank; a bearing member couples with the shaft portion and supports the stirring member to possibly rotate around the shaft portion serving as rotation axis and to possibly move along a axis direction of the rotation axis; a driving section drives the stirring member to rotate; and a judging section judges a remainder amount of the developer in the accommodating tank, wherein the stirring member is controlled to move along an axis direction of the rotation axis together with rotating along a rotation direction of the rotation axis.

21 Claims, 16 Drawing Sheets

*PRIOR ART*

DEVELOPER STIRRING UNIT, DEVELOPING DEVICE AND IMAGE FORMING APPARATUS

FIELD OF THE INVENTION

The invention relates to a developer stirring unit for stirring developer, a developing device including the developer stirring unit, and an image forming apparatus comprising the developing device; especially, relates to a developer stirring unit, a developing device and an image forming apparatus that can detect remainder amount of developer.

BACKGROUND OF THE INVENTION

In recent years, many image forming apparatuses of electronic photography type are utilized such as printer, facsimile apparatus, copying apparatus, multiplex apparatus and the like. As such apparatus, it has an image formation composed of respective processes of charging, exposing, developing, transferring, fixing and cleaning. In these processes, developing process is to use a developing device to make developing roller serving as developer carrying body carry developer (i.e. toner) so as to perform a development of electrostatic latent image with respect to photosensitive drum serving as an electrostatic latent image carrying body.

In such developing device, besides the developing roller, a supplying roller for supply toner to the developing roller, and a toner stirring unit for stirring toner as developer stirring unit are furnished.

FIG. 16A is a first explanatory diagram showing a conventional toner stirring unit; and FIG. 16B is a second explanatory diagram showing a conventional toner stirring unit.

A toner stirring unit 100, as shown by FIG. 16A, includes a toner hopper 102 for accommodating toner 101 as accommodating tank; a stirring bar 103 as stirring member; and a driving section 104. The stirring bar 103 has a built-in magnet 105; and is supported to freely rotate by a supporting pivot 106 in the toner hopper 102. On one end of the supporting pivot 106, a projection portion 106*a* is formed, the driving section 104 presses the projection portion 106*a* to make the supporting pivot 106 and the stirring bar 103 rotate along a direction of arrow "A". Further, under the toner hopper 102, a magnetic sensor 107 is furnished which can detects strength of magnetic field coming from the magnet 105.

When a rotation force is transferred from a driving unit (not shown) so that the driving section 104 rotates, the stirring bar 103 rotates together with the supporting pivot 106, after its tip rotated to an uppermost position i.e. an upper dead point position, the stirring bar 103 rotates to drop quicker than the driving section 104 through its own weight. Then, as shown by FIG. 16A, the stirring bar 103 stops on the toner 101 accommodated in the toner hopper 102. At that time, a control circuit (not shown) judges a stop position of the stirring bar 103 so as to judge a remainder amount of the toner 101 in the toner hopper 102, on the basis of the strength of magnetic field detected by the magnetic sensor 107. It may refer to Patent Document 1.

Patent Document 1: Japan patent publication of No. Heisei 09-054488.

However, in such conventional toner stirring unit 100, in the case that the remainder amount of the toner 101 in the toner hopper 102 becomes little, as shown by FIG. 16B, the stirring bar 103 produces rebound or vibration when dropping to the toner 101. Therefore, there is problem that the remainder amount of toner could not be correctly judged.

SUMMARY OF THE INVENTION

It is, therefore, an object of the invention to provide a developer stirring unit, a developing device and an image forming apparatus that can solve the above problem, so as to correctly judge a remainder amount of developer in accommodating tank.

A first aspect of the invention is to provide a developer stirring unit, the developer stirring unit comprises a accommodating tank that accommodates developer; a stirring member that has at least one shaft portion and is used to stir the developer accommodated in the accommodating tank; a bearing member that couples with the shaft portion, and supports the stirring member to possibly rotate around the shaft portion serving as rotation axis and to possibly move along a axis direction of the rotation axis; a driving section that drives the stirring member to rotate; and a judging section that judges a remainder amount of the developer in the accommodating tank, wherein the stirring member is controlled to move along an axis direction of the rotation axis together with rotating along a rotation direction of the rotation axis.

A second aspect of the invention is to provide a developing device, the developing device comprises a developer stirring unit that includes a accommodating tank that accommodates developer; a stirring member that has at least one shaft portion and is used to stir the developer accommodated in the accommodating tank; a bearing member that couples with the shaft portion, and supports the stirring member to possibly rotate around the shaft portion serving as rotation axis and to possibly move along a axis direction of the rotation axis; a driving section that drives the stirring member to rotate; and a judging section that judges a remainder amount of the developer in the accommodating tank, wherein the stirring member is controlled to move along an axis direction of the rotation axis together with rotating along a rotation direction of the rotation axis.

A third aspect of the invention is to provide an image forming apparatus, the image forming apparatus comprises a developing device, wherein the developing device has a developer stirring unit that includes a accommodating tank that accommodates developer; a stirring member that has at least one shaft portion and is used to stir the developer accommodated in the accommodating tank; a bearing member that couples with the shaft portion, and supports the stirring member to possibly rotate around the shaft portion serving as rotation axis and to possibly move along a axis direction of the rotation axis; a driving section that drives the stirring member to rotate; and a judging section that judges a remainder amount of the developer in the accommodating tank, wherein the stirring member is controlled to move along an axis direction of the rotation axis together with rotating along a rotation direction of the rotation axis.

The Effect of the Present Invention

According to the developer stirring unit, the developing device and the image forming apparatus of the invention, because the stirring member drops in accordance with bearing member while moving along a rotation axis direction, even if developer in accommodating tank becomes little, rebound or vibration can be prevented from occurring. Therefore, it is possible to correctly judge remainder amount of developer.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings. Here, it is to explain example when applying the present invention to a stirring unit, a developing device which has the toner stirring unit and an electronic photographic printer which includes the developing device.

Embodiment 1

Figure 2:
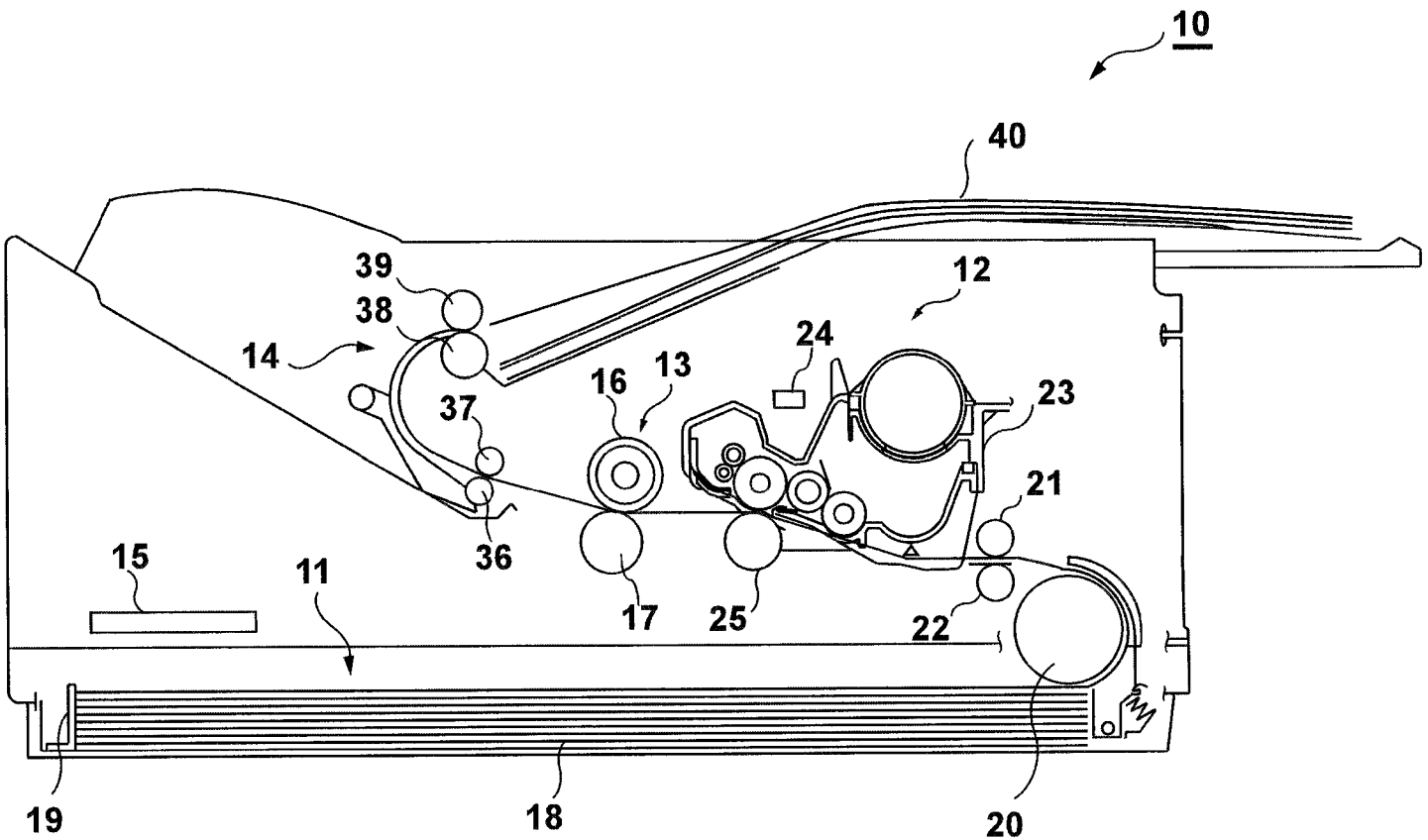
FIG. 2 is a cross-sectional side view showing a summary structure of printer of the present invention.

FIG. 2 is a cross-sectional side view showing a summary structure of printer of the present invention.

A printer 10, as an image forming apparatus of electronic photographic type, which includes a developing device containing toner stirring unit, as shown by FIG. 2, comprises a paper feeding mechanism section 11, a printing mechanism section 12, a fixing mechanism section 13 and a paper ejecting mechanism section 14.

Further, the printer 10 comprises a printer controlling section (not shown) for controlling the respective sections 11~14. The printer controlling section includes a control substrate 15 to perform supply of voltage from a power source (not shown) to respective sections; perform drives of respective motors (not shown) for controlling respective rollers (described below) to rotate; perform print control and the like on the basis of information of respective sensors. Further, the printer controlling section, as a judging section, has a function to judge remainder amount of toner (i.e. developer).

With a start of print process, the printer controlling section starts to supply electric current to the fixing mechanism section 13.

The fixing mechanism section 13, as shown by FIG. 2, includes a heat roller 16 having a built-in heat source; and a backup roller 17.

When the surface of the heat roller 16 comes to a predetermined fixation temperature, the printer controlling section controls respective rollers in the printing mechanism section 12 to rotate. Then, at a predetermined timing, the paper feeding mechanism section 11 starts to feed paper to the printing mechanism section 12.

The paper feeding mechanism section 11, as shown by FIG. 2, includes a cassette 19 which is furnished on the underside of the printer 10 and in which plural print medium 18 are accumulated; a hopping roller 20; an upper registration roller 21 and a lower registration roller 22.

When the hopping roller 20 starts to rotate by a control of the printer controlling section, the print medium 18 accommodated in the cassette 19 is conveyed to medium conveyance route. Then, through rotation of the upper registration roller 21 and the lower registration roller 22, the print medium 18 is conveyed to the printing mechanism section 12.

Figure 3:
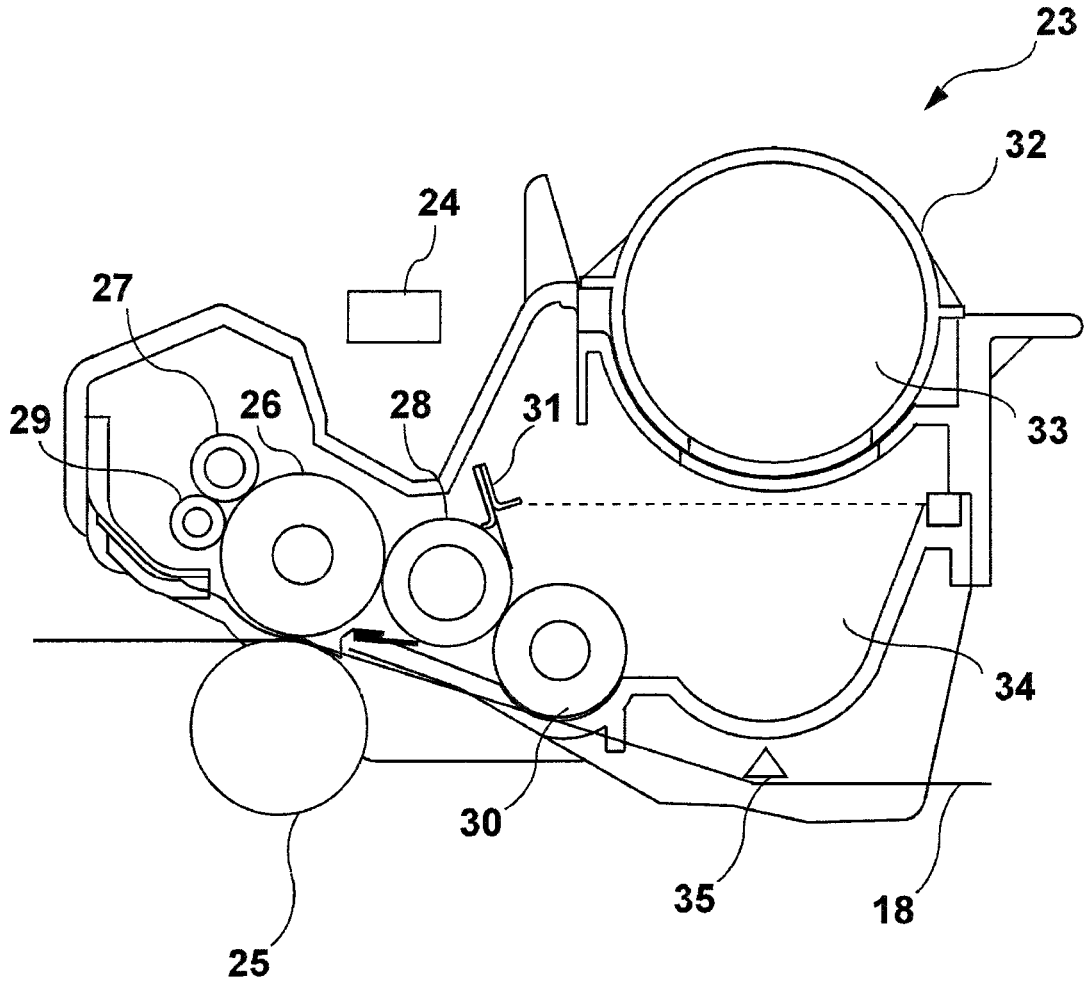
FIG. 3 is a cross-sectional side view showing a summary structure of print mechanism section.

FIG. 3 is a cross-sectional side view showing a summary structure of print mechanism section.

The printing mechanism section 12, as shown by FIGS. 2 and 3, is composed of image forming unit 23 containing developing device; exposing unit 24 and transfer roller 25.

The image forming unit 23 has a photosensitive drum 26 as an image carrying body. The photosensitive drum 26 is furnished to expose from the underside of the image forming unit 23 so that its surface contacts with the transfer roller 25.

In the image forming unit 23, around the photosensitive drum 26, a charging roller 27 serving as charging unit, a developing roller 28 serving as developer carrying body, and a cleaning roller 29 serving as cleaning means are furnished to contact with the surface of the photosensitive drum 26.

Further, in the image forming unit 23, a sponge roller 30 serving as developer supply member, and a blade 31 serving as layer regulating member are furnished around the developing roller 28.

Furthermore, on the upside of the image forming unit 23, a toner cartridge 32 is removably attached for accommodating toner serving as developer. The toner cartridge 32 has a toner accommodating space 33 for accommodating toner, and has a shutter (not shown). After the toner cartridge 32 is installed in a predetermined position, when a lever (not shown) is rotated, the shutter of the toner cartridge 32 is opened, the toner accommodated in the toner accommodating space 33 is replenished to a toner keeping space 34 inside the image forming unit 23 and is kept in the toner keeping space 34. The toner kept in the toner keeping space 34 is supplied by the developing roller 28, and a toner layer with a predetermined thickness is formed on the surface of the developing roller 28 by the blade 31.

Further, in the image forming unit 23, a sensor section 35 is furnished for detecting toner remainder amount in the toner keeping space 34. Regarding a detail explanation of the sensor section 35, it will be stated below.

When the print medium 18 fed by the paper feeding mechanism section 11 reaches a predetermined position, the printer controlling section controls the charging roller 27 to uniformly charge the surface of the photosensitive drum 26, and controls the exposing unit 24 to emit light. Thereby, on the surface of the photosensitive drum 26, an electrostatic latent image is formed. Then, toner on the developing roller 28 adheres to the electrostatic latent image so that a toner image is formed on the surface of the photosensitive drum 26.

When the print medium 18 is conveyed and reaches between the photosensitive drum 26 and the transfer roller 25, the toner image on the photosensitive drum 26 is transferred onto the surface of the print medium 18 by the transfer roller 25. Then, transfer remainder toner that is remaining on the surface of the photosensitive drum 26 is removed by the cleaning roller 29. The print medium 18 on which the toner image is transferred, is further conveyed to the fixing mechanism section 13.

In the fixing mechanism section 13, the heat roller 16 is driven to rotate, with the rotation of the heat roller 16, the backup roller 17 is also driven to rotate. When the print medium 18 is conveyed in between the heat roller 16 and the backup roller 17, the print medium 18 is heated and pressed so that the toner image transferred in the printing mechanism section 12 is fixed. Later, the print medium 18 is conveyed from the fixing mechanism section 13 to the paper ejecting mechanism section 14.

The paper ejecting mechanism section 14, as shown by FIG. 2, includes ejecting rollers 36~39, and stacker 40 used for stacking the print medium 18.

When the print medium 18 which is performed by a fixing process of toner image by the fixing mechanism section 13, is conveyed to the paper ejecting mechanism section 14, through a control of the printer controlling section, the respective ejecting rollers 36~39 start to rotate. The print medium 18, after conveyed by the ejecting rollers 36~37, is ejected to the stacker 40 furnished at the upside of the printer 10 by the ejecting rollers 38~39.

Next, it is to explain a detail structure of the image forming unit 23.

Figure 4:
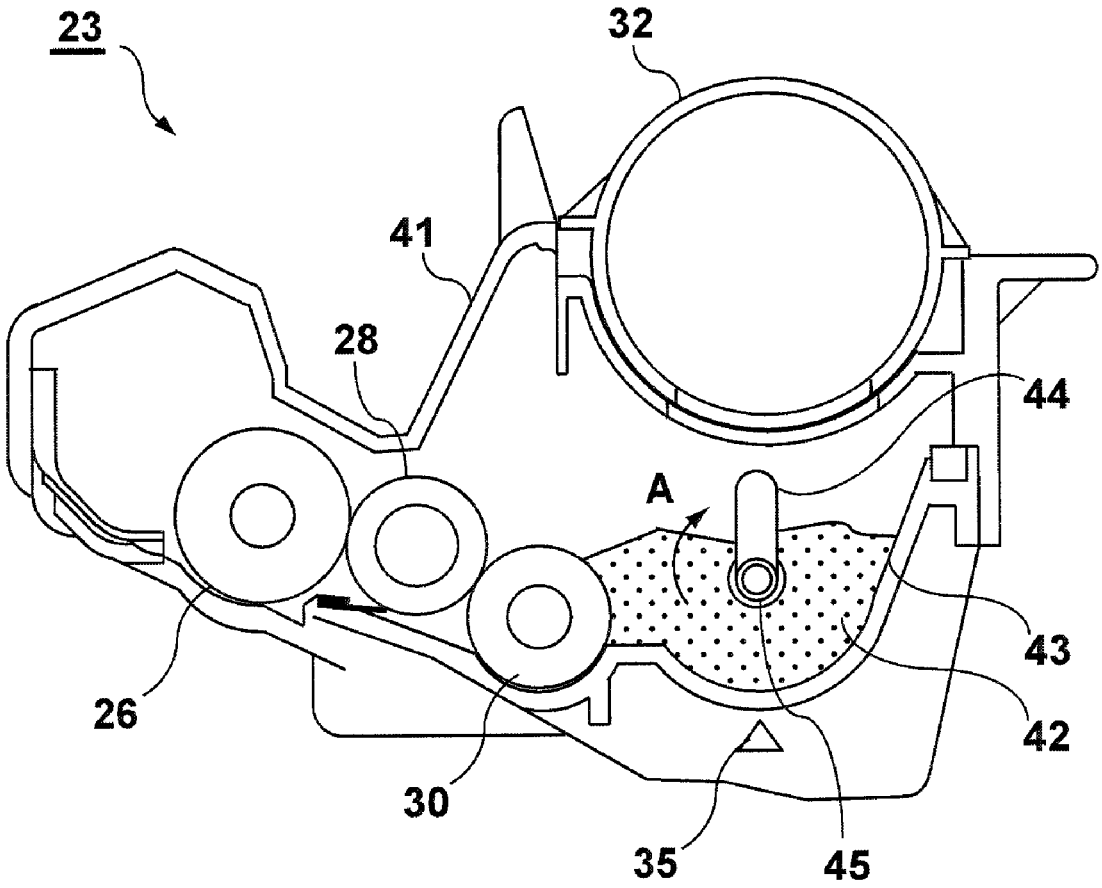
FIG. 4 is a first cross-sectional side view showing a structure of image forming unit containing toner stirring unit of the present invention.

FIG. 4 is a first cross-sectional side view showing a structure of image forming unit containing toner stirring unit of the present invention.

The image forming unit 23 includes a developing device. The developing device has a toner stirring unit as a developer stirring unit. Further, the image forming unit 23 includes a unit body section 41, in the unit body section 41, a toner hopper 43 is furnished as a accommodating tank in which toner 42 is accommodated.

On the upper of the unit body section 41 of the image forming unit 23, the toner cartridge 32 is installed for replenishing the toner 42 to the toner keeping space 34 (FIG. 3) formed by the toner hopper 43. Further, in the unit body section 41, as shown by FIG. 3, the photosensitive drum 26, the developing roller 28 and the sponge roller 30 are furnished, the sponge roller 30 supplies the toner 42 accommodated in the toner hopper 43 to the developing roller 28, the developing roller 28 further supplies the toner to the photosensitive drum 26.

In the toner hopper 43, a stirring bar 44 is furnished as stirring member.

Figure 5:
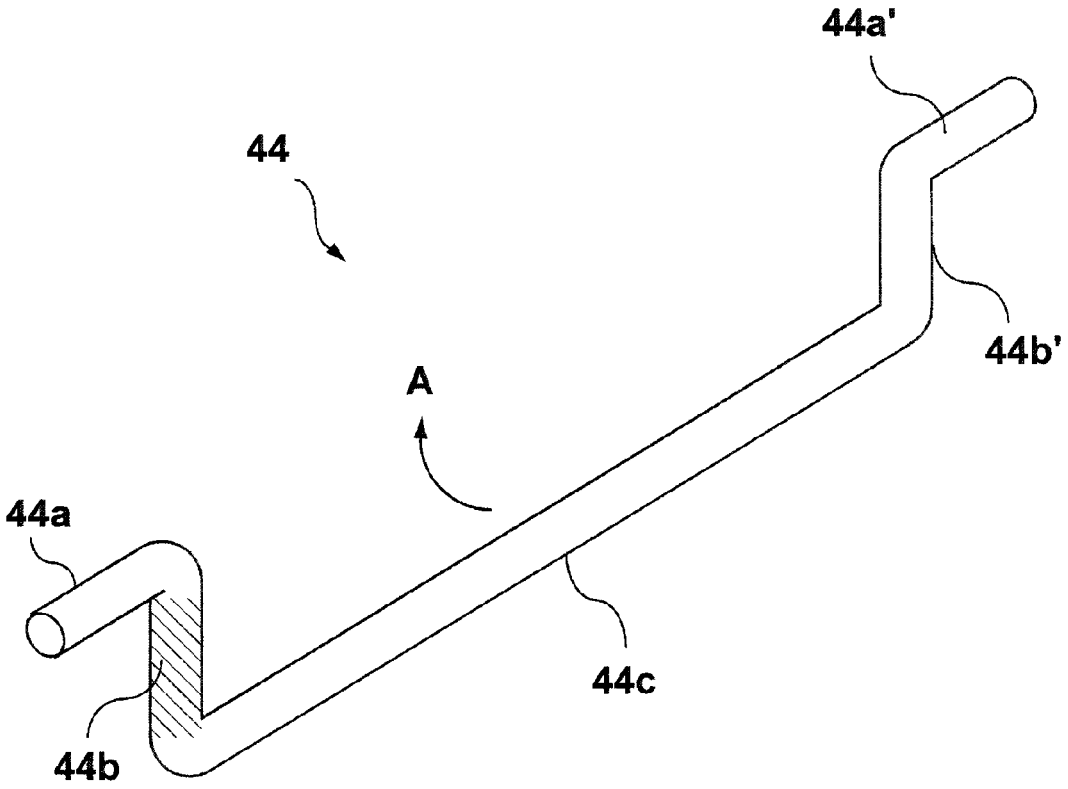
FIG. 5 is a summary cubic diagram showing a stirring bar.

FIG. 5 is a summary cubic diagram showing a stirring bar.

The stirring bar 44 is made from iron in the embodiment, and is rotatively supported by bearing drive member and bearing member that will be described below. The stirring bar 44, as shown by FIG. 5, has a stirring portion 44*c* that is in parallel with rotation axis; orthogonal portions 44*b* and 44*b*' that extend from two ends of the stirring portion 44*c* along an orthogonal direction being at right angles to the stirring portion 44*c*; and shaft portions 44*a* and 44*a*' that are furnished on ends of the orthogonal portions 44*b* and 44*b*' and serve as rotation shafts coinciding with rotation axis line. The stirring bar 44 regards the shaft portions 44*a* and 44*a*' as center, rotates along a direction of an arrow A so as to use the stirring portion 44*c* to stir the toner 42 accommodated in the toner hopper 43.

In the image forming unit 23, the sensor section 35 is placed under the toner hopper 43 as position detection section.

Figure 6A:
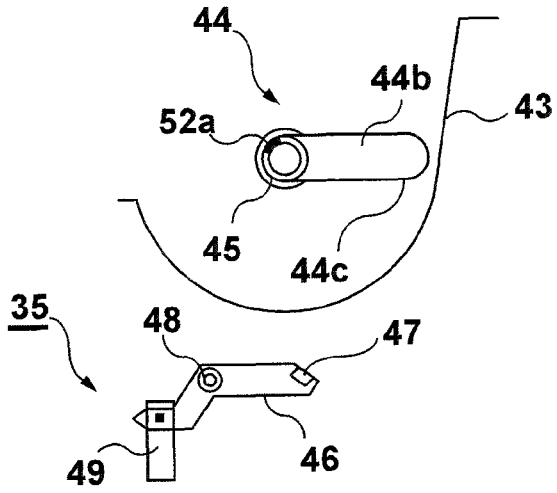
FIG. 6A is a first diagram for explaining structure and operation of a sensor section.
Figure 6B:
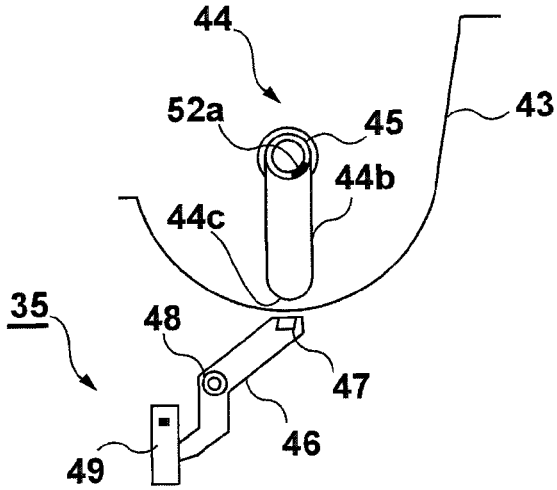
FIG. 6B is a second diagram for explaining structure and operation of a sensor section.

FIG. 6A is a first diagram for explaining structure and operation of a sensor section; FIG. 6B is a second diagram for explaining structure and operation of a sensor section; and FIG. 6C is a third diagram for explaining structure and operation of a sensor section.

Figure 6C:
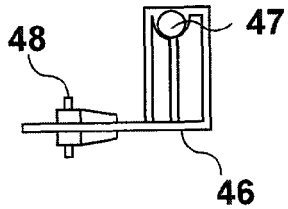
FIG. 6C is a third diagram for explaining structure and operation of a sensor section

FIGS. 6A and 6B show rotation operation of sensor lever; and FIG. 6C is a plane view by observing the sensor lever from the upside (the side of the toner hopper 43).

The sensor section 35, as shown by FIGS. 6A~6C, is formed to contain a sensor lever 46. The sensor lever 46, as shown by FIGS. 6A and 6B, is formed like a shape of "<" character. On the front edge of the sensor lever 46, a magnet 47 is furnished. A center portion is supported by a support shaft 48 to be rotatable.

Further, near to the back edge of the sensor lever 46, a sensor 49 is furnished for detecting position of the back edge of the sensor lever 46. In the embodiment, the sensor 49 is a photo sensor having light emitting element and light receiving element, the sensor 49 detects shining state or shading state and outputs ON/OFF signal to the printer controlling section according to the detection.

For example, on the one hand, as shown by FIG. 6A, the stirring portion 44*c* of the stirring bar 44 locates in a lowermost position of a bearing drive member 45 with which the shaft portion 44*a* is coupled, that is, locates in a position separating from a lower dead point position. In the case, the front edge of the sensor lever 46 locates in a drop position due to deadweight, the sensor 49 detects a shading state on the basis of the position of the back edge of the sensor lever 46, and outputs an OFF signal.

On the other hand, as shown by FIG. 6B, such case is shown that the stirring portion 44*c* of the stirring bar 44 locates in lower dead point position. In the case, because the magnet 47 is attracted by the stirring bar 44 made from iron, the front edge of the sensor lever 46 rotates to rise along a counter-clockwise direction from the state of FIG. 6A, and the back edge of the sensor lever 46 drops. Meanwhile, the sensor 49 detects a shining state and outputs an OFF signal.

The printer controlling section, as position detecting section and judging section, when ON/OFF signal is inputted from the sensor 49, judges a remainder amount of the toner 42 in the toner hopper 43 on the basis of the signal. That is, when OFF signal is inputted, the printer controlling section judges that the toner remainder amount is not little; when ON signal is inputted, the printer controlling section judges that the toner remainder amount is little.

Moreover, as a position detecting section, instead of the sensor section 35, magnetic sensor also can be applied. In the case, through furnishing a magnet to the inside of the stirring portion 44*c* of the stirring bar 44, the magnetic sensor detects the strength of magnetic field produced by the magnet. Then, the printer controlling section can obtain position information of the stirring portion 44*c* on the basis of detection information. The printer controlling section performs a judgment of toner remainder amount on the basis of the obtained position information.

Next, it is to explain structure of toner stirring unit of the embodiment.

Figure 1A:
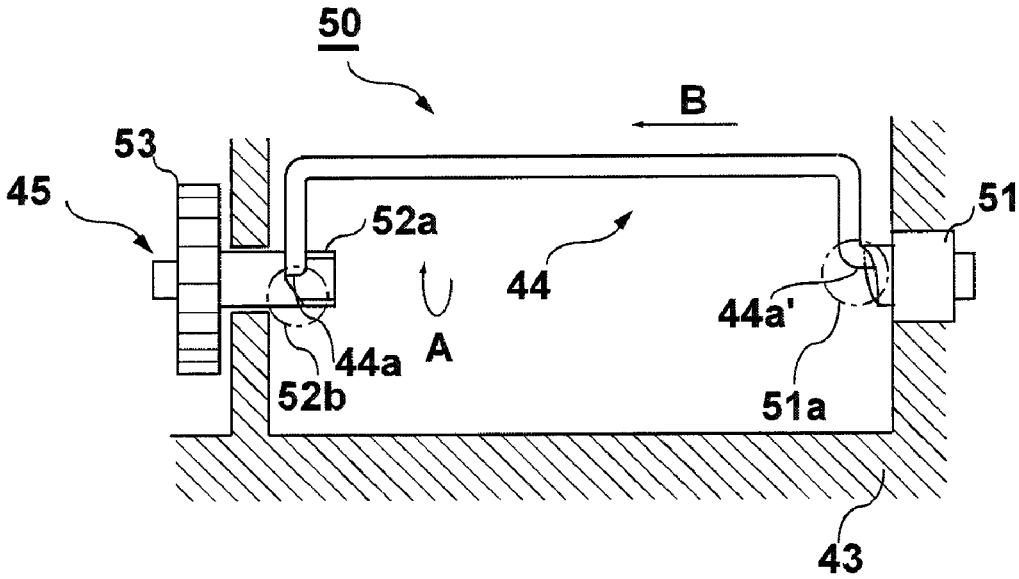
FIG. 1A is a first cross-sectional diagram showing a main structure of toner stirring unit in embodiment 1 of the present invention.
Figure 1B:
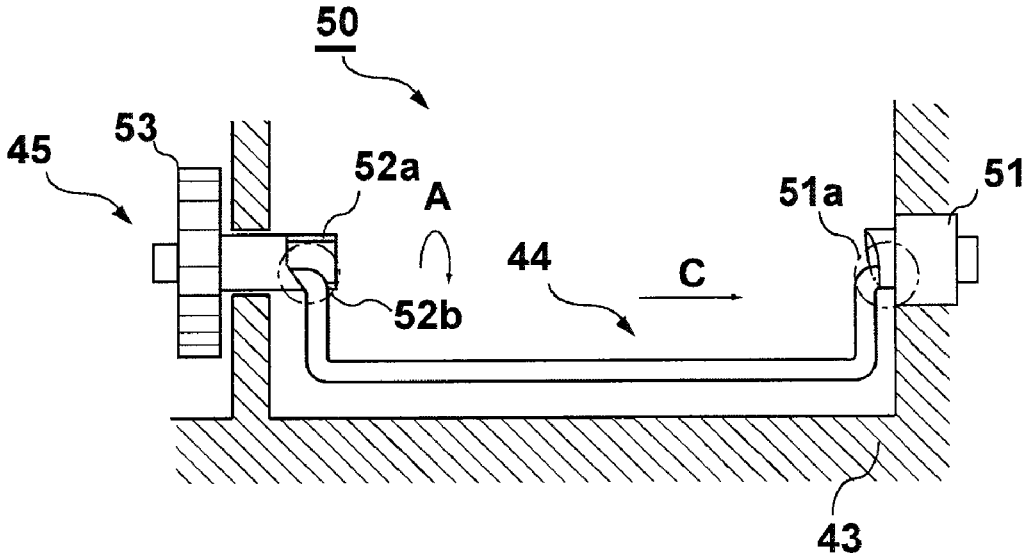
FIG. 1B is a second cross-sectional diagram showing a main structure of toner stirring unit in embodiment 1 of the present invention.

FIG. 1A is a first cross-sectional diagram showing a main structure of toner stirring unit in embodiment 1 of the present invention; and FIG. 1B is a second cross-sectional diagram showing a main structure of toner stirring unit in embodiment 1 of the present invention.

In a toner stirring unit 50 of the embodiment, on the side wall portion of the toner hopper 43, a bearing member 51 which supports the stirring bar 44 to possibly rotate, and a bearing drive member 45 are furnished respectively.

The bearing member 51 is fixed on the side wall portion of the toner hopper 43, and couples with the shaft portion 44*a*' of the stirring bar 44 as shown by FIGS. 1A and 1B.

Figure 7:
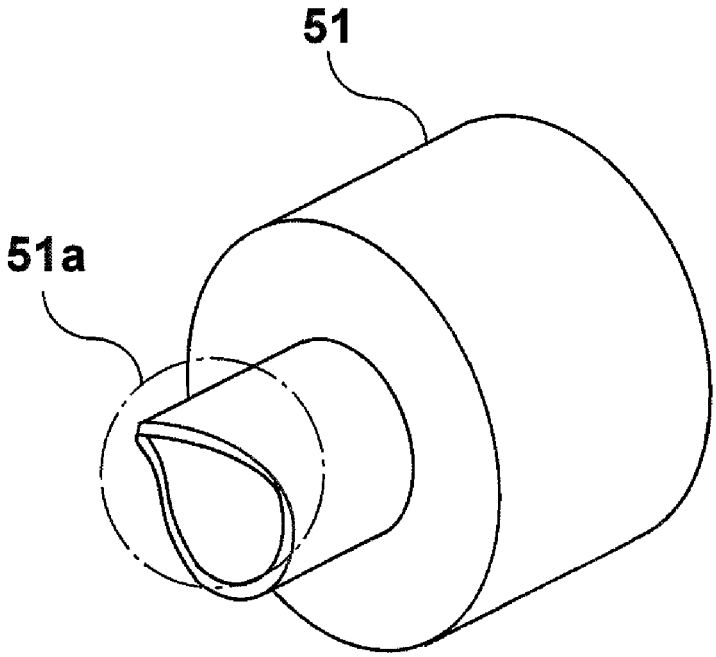
FIG. 7 is a cubic diagram showing a structure of bearing member.

FIG. 7 is a cubic diagram showing a structure of bearing member.

As shown by FIG. 7, the bearing member 51 has an open end. As shown by FIGS. 1A and 1B, the shaft portion 44*a*' of the stirring bar 44 is inserted into the open end. An inner diameter of the open end of the bearing member 51 is set to be bigger than an outer diameter of the shaft portion 44*a*' in order to possibly move the stirring bar 44 along a rotation axis direction i.e. a direction of an arrow B (FIG. 1A) or a direction of an arrow C (FIG. 1). Further, on the open end, as shown by FIG. 7, a slant portion 51*a* is furnished as a bearing slant portion, the bearing member 51 is regulated a position of the stirring bar 44 in the rotation axis direction on the basis of the shape of the slant portion 51*a*.

The bearing drive member 45, as bearing member and drive member, is placed on the side wall portion of the toner hopper 43; and couples with the shaft portion 44*a* as shown by FIGS. 1A and 1B.

Figure 8:
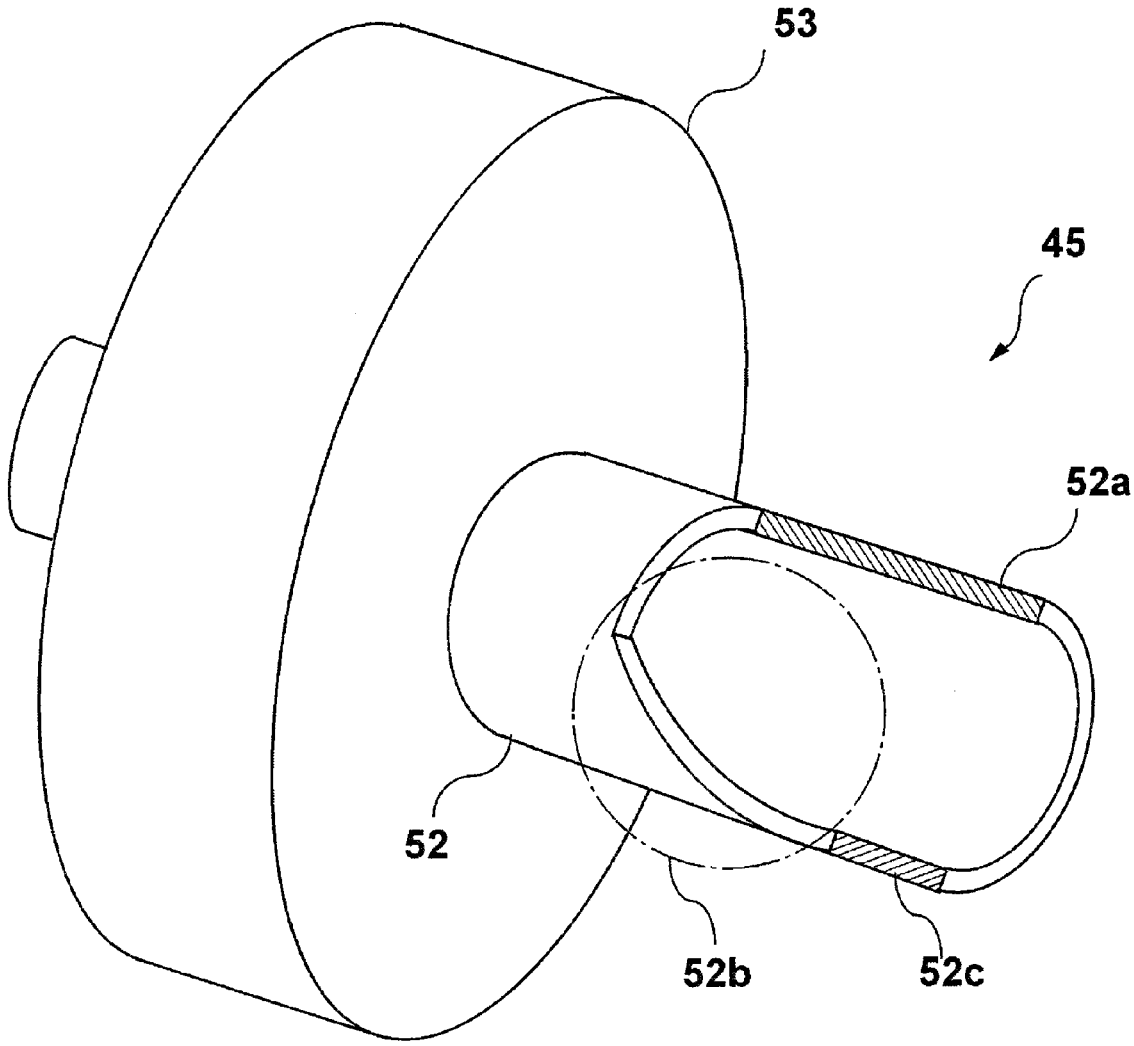
FIG. 8 is a cubic diagram showing a structure of bearing drive member in embodiment 1.

FIG. 8 is a cubic diagram showing a structure of bearing drive member in embodiment 1.

The bearing drive member 45, as shown by FIG. 8, has a cylindrical portion 52 and a stirring gear 53 coupled with the cylindrical portion 52.

The cylindrical portion 52 of the bearing drive member 45, as shown by FIGS. 1A and 1B, is rotatively supported by the side wall portion of the toner hopper 43, and the shaft portion 44*a* of the stirring bar 44 is inserted into the cylindrical portion 52. The inner diameter of the cylindrical portion 52 is also set to be bigger than the outer diameter of the shaft portion 44*a* as well as the inner diameter of the open end of the bearing member 51.

The cylindrical portion 52, as shown by FIG. 8, has a broken part which is formed on the open end. On the broken part, a drive portion 52*a*, a slant portion 52*b* and a contact portion 52*c* are formed.

The drive portion 52*a* is a part to press the shaft portion 44*a* of the stirring bar 44 and drive the stirring bar 44 to rotate.

The slant portion 52*b* regulates the position of the stirring bar 44 in the rotation axis direction on the basis of the shape of itself, as bearing slant portion.

The contact portion 52*c* is a part to contact the stirring bar 44 when the stirring bar 44 drops toward the lower dead point position (FIG. 1B).

The bearing drive member 45 makes one end of the cylindrical portion 52 project toward the outside of the side wall portion of the toner hopper 43. Then, the stirring gear 53 is coupled with the projecting part. The stirring gear 53 rotates with the rotation of the photosensitive drum 26 (FIG. 4), so as to drive the cylindrical portion 52 to rotate. Regarding these rotations, they are explained by using FIG. 9.

Figure 9:
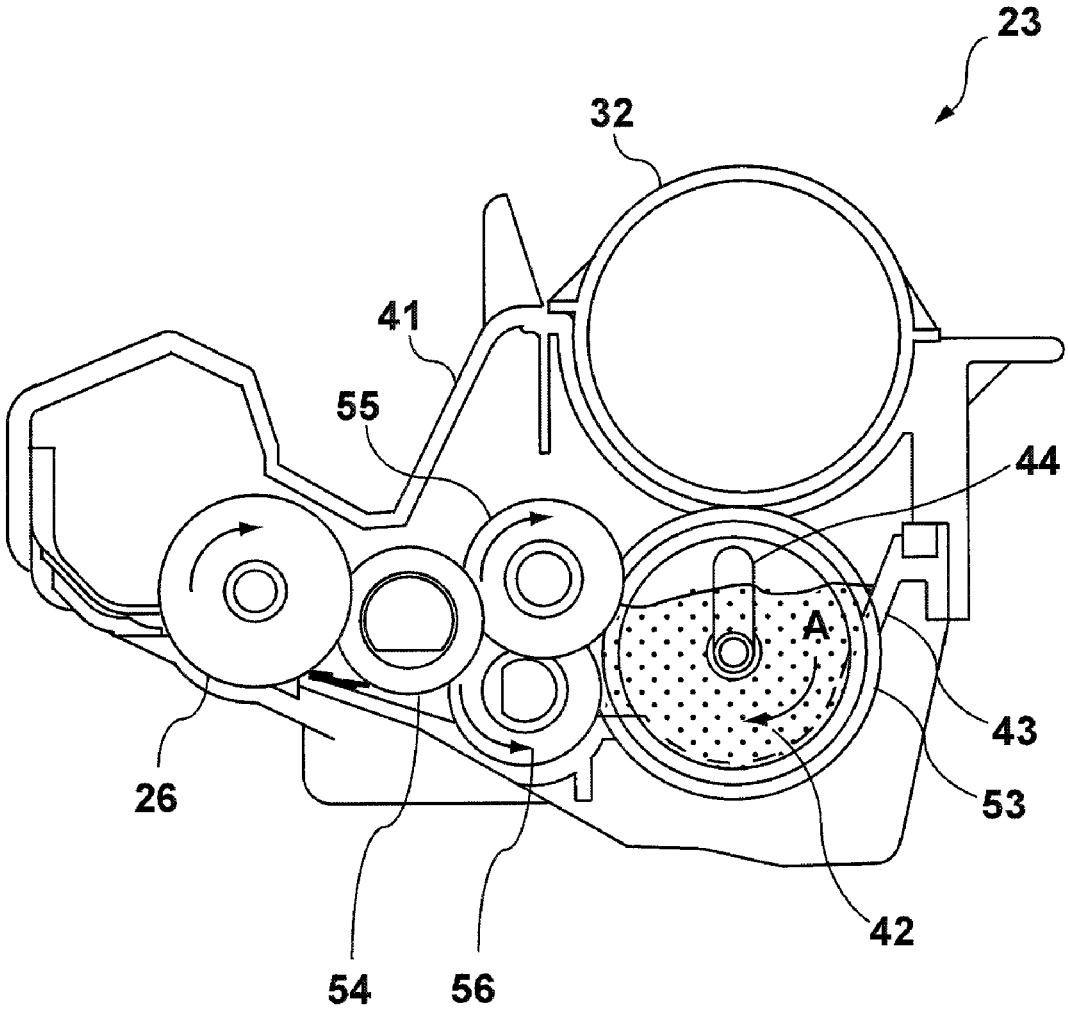
FIG. 9 is a second cross-sectional side view showing a structure of image forming unit containing toner stirring unit of the present invention.

FIG. 9 is a second cross-sectional side view showing a structure of image forming unit containing toner stirring unit of the present invention.

In the image forming unit 23, as shown by FIG. 9, a gear member 54 engaging with the photosensitive drum 26; a gear member 55 engaging with the gear member 54; and a gear member 56 engaging with the gear member 55 are furnished respectively as a rotation drive mechanism section.

Through rotations in the rotation drive mechanism section, the bearing drive member 45 rotates together with the stirring gear 53 and the cylindrical portion 52. When the drive portion 52*a* of the cylindrical portion 52 contacts with the shaft portion 44*a* of the stirring bar 44, the stirring bar 44 is pressed through the drive portion 52*a* drives the shaft portion 44*a* so as to rotate together with the bearing drive member 45.

Next, it is to explain rotation operation of the stirring bar 44 in the toner stirring unit 50 in detail.

First is to explain stirring operation to stir the toner 42 in the toner stirring unit 50 and remainder amount judging operation of the toner 42 in the printer 10 on which the toner stirring unit 50 is installed by using drawing, in the case that a lot of toner 42 is accommodated in the toner hopper 43.

Figure 10A:
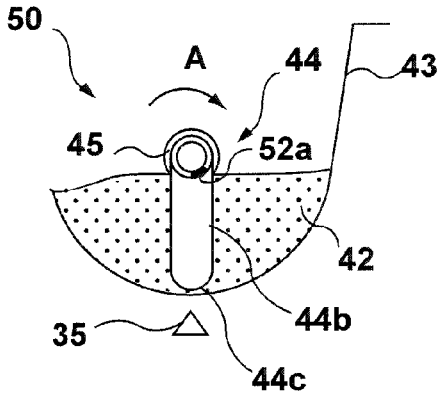
FIG. 10A is a first diagram for explaining stirring operation of toner stirring unit when a lot of toner is accommodated in embodiment 1 of the present invention.
Figure 10D:
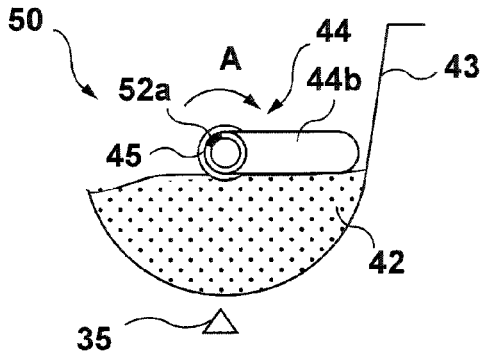
FIG. 10D is a fourth diagram for explaining stirring operation of toner stirring unit when a lot of toner is accommodated in embodiment 1 of the present invention.
Figure 10B:
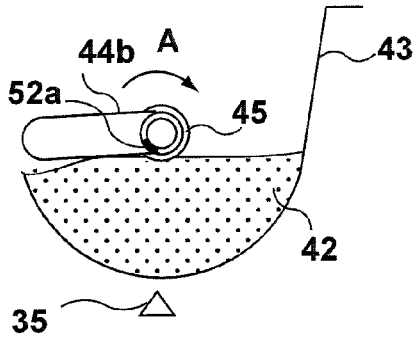
FIG. 10B is a second diagram for explaining stirring operation of toner stirring unit when a lot of toner is accommodated in embodiment 1 of the present invention.
Figure 10E:
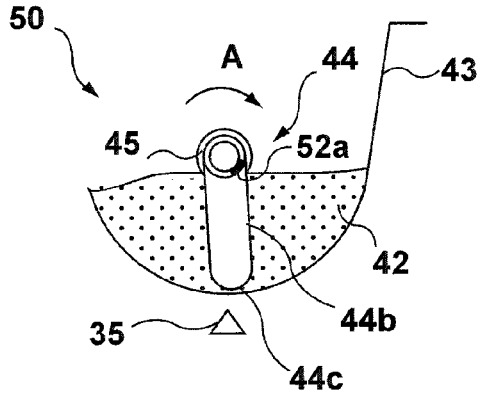
FIG. 10E is a fifth diagram for explaining stirring operation of toner stirring unit when a lot of toner is accommodated in embodiment 1 of the present invention.
Figure 10C:
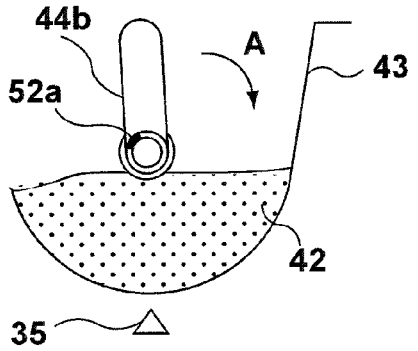
FIG. 10C is a third diagram for explaining stirring operation of toner stirring unit when a lot of toner is accommodated in embodiment 1 of the present invention.

FIG. 10A is a first diagram for explaining stirring operation of toner stirring unit when a lot of toner is accommodated in embodiment 1 of the present invention; FIG. 10B is a second diagram for explaining stirring operation of toner stirring unit when a lot of toner is accommodated in embodiment 1 of the present invention; FIG. 10C is a third diagram for explaining stirring operation of toner stirring unit when a lot of toner is accommodated in embodiment 1 of the present invention; FIG. 10D is a fourth diagram for explaining stirring operation of toner stirring unit when a lot of toner is accommodated in embodiment 1 of the present invention; and FIG. 10E is a fifth diagram for explaining stirring operation of toner stirring unit when a lot of toner is accommodated in embodiment 1 of the present invention.

In the toner stirring unit 50, the bearing drive member 45 (FIG. 1) rotates at a predetermined speed, synchronously with the rotation of the photosensitive drum 26, through the rotation drive mechanism section shown by FIG. 9. Then, when the drive portion 52*a* of the cylindrical portion 52 contacts the shaft portion 44*a* of the stirring bar 44, with the rotation of the bearing drive member 45, the shaft portion 44*a* is pressed by the drive portion 52*a*. Thereby, the stirring bar 44 is driven to rotate, and rotates along a direction of an arrow A as shown by FIGS. 10A and 10B.

The bearing drive member 45 and the stirring bar 44 rotate together, as shown by FIGS. 1A and 10C, when the stirring portion 44*c* of the stirring bar 44 reaches the upper dead point position and slightly passes through the upper dead point position, the stirring bar 44 rotates to drop quicker than the drive portion 52*a* due to deadweight. Then, as shown by FIG. 10D, the stirring portion 44*c* of the stirring bar 44 reaches the upper surface of the toner 42 accumulated in the toner hopper 43 and stops on the upper surface. That is, it is possible to a remainder amount of the toner 42 in the toner hopper 43 on the basis of a stop position of the stirring portion 44*c*.

In the printer 10 on which the toner stirring unit 50 is installed, the printer controlling section judges the remainder amount of the toner 42 on the basis of an input signal outputted just after the drive portion 52*a* of the bearing drive member 45 reaches an uppermost position (FIG. 10C), from the sensor section 35. As shown by FIG. 10D, in the case that the stirring portion 44*c* stops in a position separating from a lower dead point position, the front edge of the sensor lever 46 of the sensor section 35 drops due to deadweight as shown by FIG. 6A. At that time, the sensor 49 detects a shading state on the basis of a position of the back edge of the sensor lever 46, and outputs OFF signal. The printer controlling section judges that the stop position of the stirring portion 44*c* is not the lower dead point position, that is, judges that the remainder amount of the toner 42 in the toner hopper 43 is not little, on the basis of the input of the OFF signal outputted from the sensor 49.

The bearing drive member 45 continues to rotate at a predetermined speed after the stirring bar 44 dropped. Then, when the drive portion 52*a* catches up with the stirring bar 44 to contacts with the shaft portion 44*a*, the drive portion 52*a* rotates while pressing the shaft portion 44*a*. Thereby, the stirring portion 44*c* of the stirring bar 44 is pressed into the toner 42 accumulated in the toner hopper 43, and rotates while stirring the toner 42 (FIG. 10E). Then, the toner stirring unit 50 repeats these operations shown by the FIGS. 10A~10E.

As stated above, the remainder amount of the toner 42 in the toner hopper 43 is judged on the basis of signal outputted from the sensor section 35.

Next, it is to explain stirring operation to stir the toner 42 in the toner stirring unit 50 and remainder amount judging operation of the toner 42 in the printer 10, in the case that a little of toner 42 is accommodated in the toner hopper 43.

Figure 11A:
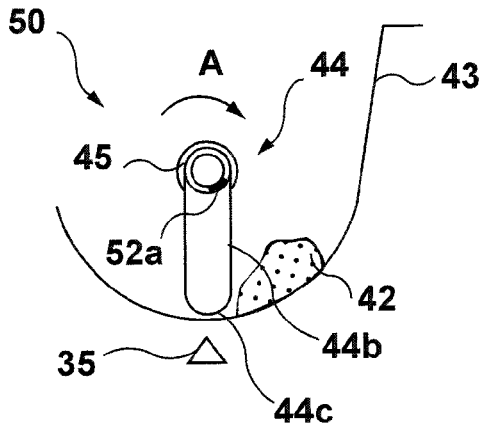
FIG. 11A is a first diagram for explaining stirring operation of toner stirring unit when a little toner is accommodated in embodiment 1 of the present invention.
Figure 11D:
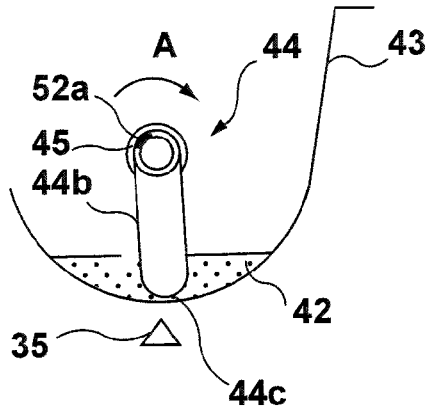
FIG. 11D is a fourth diagram for explaining stirring operation of toner stirring unit when a little toner is accommodated in embodiment 1 of the present invention.
Figure 11B:
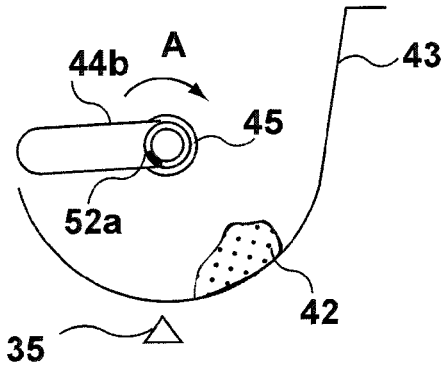
FIG. 11B is a second diagram for explaining stirring operation of toner stirring unit when a little toner is accommodated in embodiment 1 of the present invention.
Figure 11E:
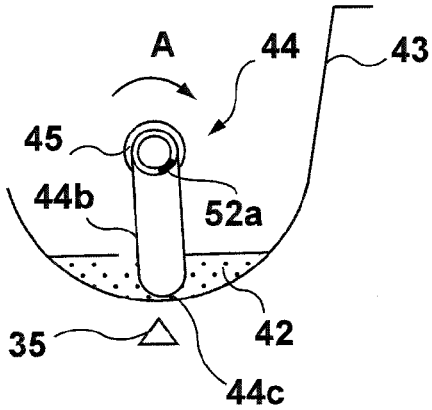
FIG. 11E is a fifth diagram for explaining stirring operation of toner stirring unit when a little toner is accommodated in embodiment 1 of the present invention.
Figure 11C:
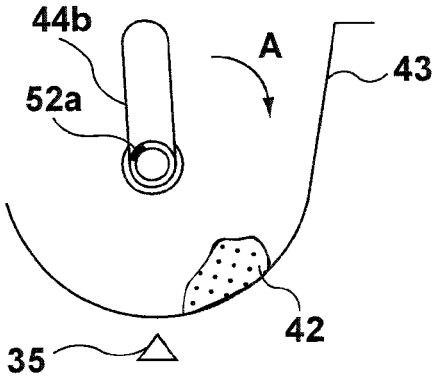
FIG. 11C is a third diagram for explaining stirring operation of toner stirring unit when a little toner is accommodated in embodiment 1 of the present invention.

FIG. 11A is a first diagram for explaining stirring operation of toner stirring unit when a little toner is accommodated in embodiment 1 of the present invention; FIG. 11B is a second diagram for explaining stirring operation of toner stirring unit when a little toner is accommodated in embodiment 1 of the present invention; FIG. 11C is a third diagram for explaining stirring operation of toner stirring unit when a little toner is accommodated in embodiment 1 of the present invention; FIG. 11D is a fourth diagram for explaining stirring operation of toner stirring unit when a little toner is accommodated in embodiment 1 of the present invention; and FIG. 11E is a fifth diagram for explaining stirring operation of toner stirring unit when a little toner is accommodated in embodiment 1 of the present invention.

When the drive portion 52*a* of the bearing drive member 45 contacts with the shaft portion 44*a* of the stirring bar 44 (FIG. 11A), and the drive portion 52*a* rotates while pressing the shaft portion 44*a*, the stirring bar 44 rotates along a direction of an arrow A together with the bearing drive member 45 as shown by FIGS. 11A and 11B.

Then, as shown by FIGS. 1A and 11C, when the stirring portion 44*c* of the stirring bar 44 reaches the upper dead point position and slightly passes through the upper dead point position, the stirring bar 44 rotates to drop quicker than the drive portion 52*a* due to deadweight. At that time, because only a little of the toner 42 is accommodated in the toner hopper 43, the stirring bar 44 drops to the lower dead point position as shown by FIG. 11D, and the shaft portion 44*a* collides with the contact portion 52*c* of the bearing drive member 45 and stop operating as shown by FIG. 1B. At that time, the toner 42 (FIG. 11C) which is in the toner hopper 43 and is coagulating and mal-distributing, is stirred by the stirring portion 44*c* so as to spread (FIG. 11D).

In the printer 10, the printer controlling section judges the remainder amount of the toner 42 in the toner hopper 43 on the basis of an input signal outputted just after the drive portion 52*a* of the bearing drive member 45 reaches an uppermost position (FIG. 11C), from the sensor section 35. When the stirring portion 44*c* stops in the lower dead point position, the front edge of the sensor lever 46 of the sensor section 35 rises because the magnet 47 is attracted by the stirring bar 44 made from iron, the back edge of the sensor lever 46 drops as shown by FIG. 6B. Therefore, the sensor 49 detects a shining state and outputs ON signal. The printer controlling section judges that the stop position of the stirring portion 44*c* is the lower dead point position, that is, judges that the remainder amount of the toner 42 in the toner hopper 43 is little, on the basis of the input of the ON signal.

The bearing drive member 45 continues to rotate at a predetermined speed, when the drive portion 52*a* contacts with the shaft portion 44*a* of the stirring bar 44, the drive portion 52*a* rotates together with the stirring bar 44 while pressing the shaft portion 44*a* (FIG. 11E). Then, the toner stirring unit 50 repeats these operations shown by the FIGS. 11A~11E.

As stated above, it is judged that the stirring bar 44 drops to the lower dead point position, and the remainder amount of the toner 42 is little.

Figure 16A:
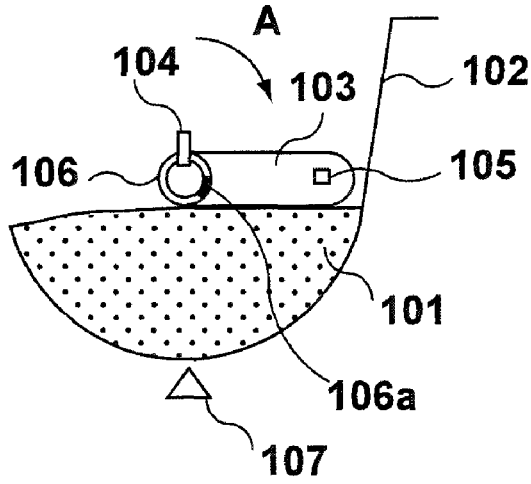
FIG. 16A is a first explanatory diagram showing a conventional toner stirring unit.
Figure 16B:
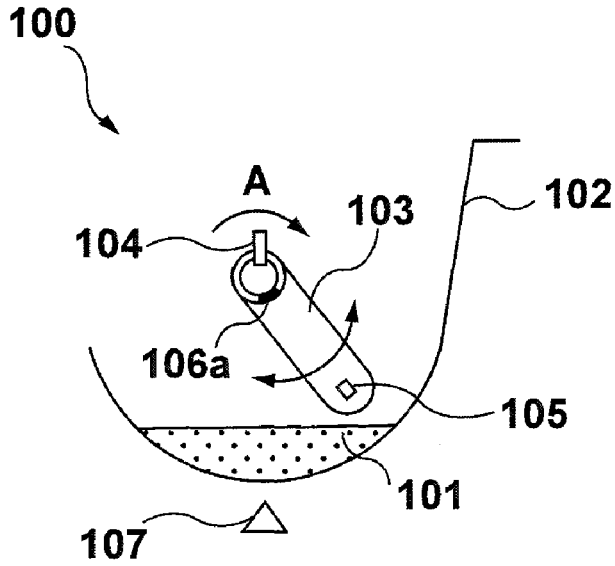
FIG. 16B is a second explanatory diagram showing a conventional toner stirring unit.

However, in conventional toner stirring unit, in the case that the remainder amount of toner in toner hopper becomes little, as shown by FIG. 16B, the stirring bar produces rebound or vibration when dropping to the lower dead point position. Therefore, there is problem that error detection occurs because of chattering phenomenon, and that the remainder amount of toner could not be correctly judged.

However, in the toner stirring unit 50 of the embodiment, the stirring bar 44 is supported to possibly rotate along a rotation axis direction through the bearing drive member 45 and the bearing member 51, when the stirring bar 44 drops toward the lower dead point position due to deadweight, once the orthogonal portion 44*b* contacts with the slant portion 52*b* of the bearing drive member 45, the orthogonal portion 44*b* smoothly drops along the slant portion 52*b* in the contact state. In the case, the stirring bar 44 moves along a direction of an arrow C shown in FIG. 1B, as a rotation axis direction, on the basis of the shape of the slant portion 52*b*. Through such smooth drop, even if the shaft portion 44*a* of the stirring bar 44 collides with the contact portion 52*c* of the bearing drive member 45, because such occurrence of rebound or vibration is inhibited, so the chattering phenomenon is prevented from happening. Therefore, the printer 10 can correctly judge the remainder amount of the toner 42 in the toner hopper 43.

Moreover, when the drive portion 52*a* catches up with the stirring bar 44 to contact with the shaft portion 44*a* (FIG. 11E), the stirring bar 44 is driven to rotate to upper dead point position by the drive portion 52*a* so as to rise (FIGS. 11A~11C). During the stirring bar 44 rises, once the orthogonal portion 44*b*' contacts with the slant portion 51*a* of the bearing member 51, the stirring bar 44 rises while moving along a direction of an arrow B (FIG. 1A) i.e. rotation axis direction in the contact state, on the basis of the shape of the slant portion 51*a*.

As stated above, in the toner stirring unit and the printer of the embodiment, slant portions are furnished on bearing member and bearing drive member, through the bearing member and the bearing drive member, stirring bar is supported to possibly rotate and possibly move along rotation axis direction. Therefore, it is possible to inhibit rebound or vibration when stirring bar drops. As a result, it is possible to correctly judge remainder amount of toner.

Embodiment 2

Figure 12A:
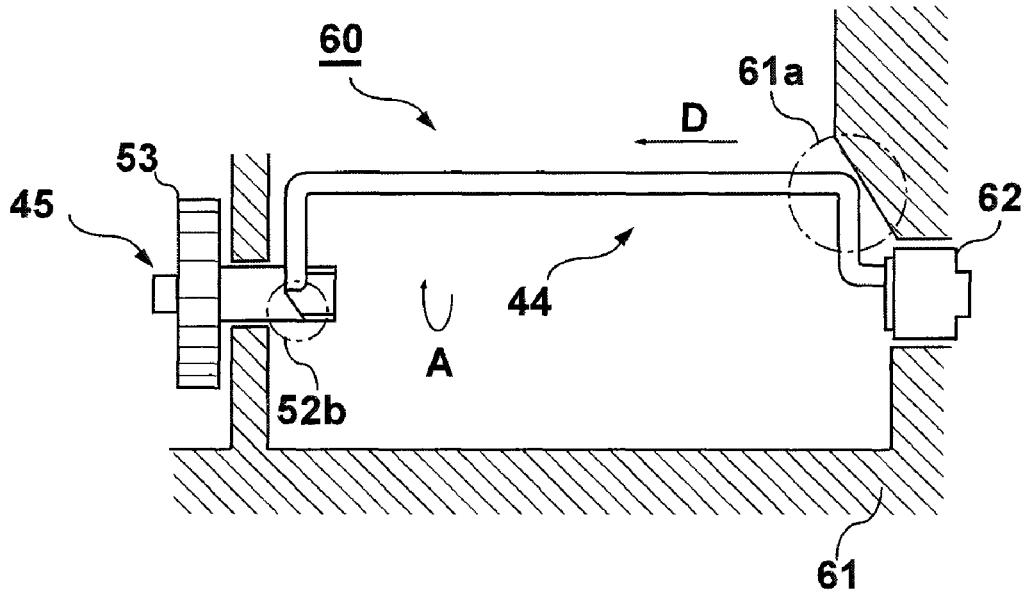
FIG. 12A is a first cross-sectional diagram showing a main structure of toner stirring unit in embodiment 2 of the present invention.
Figure 12B:
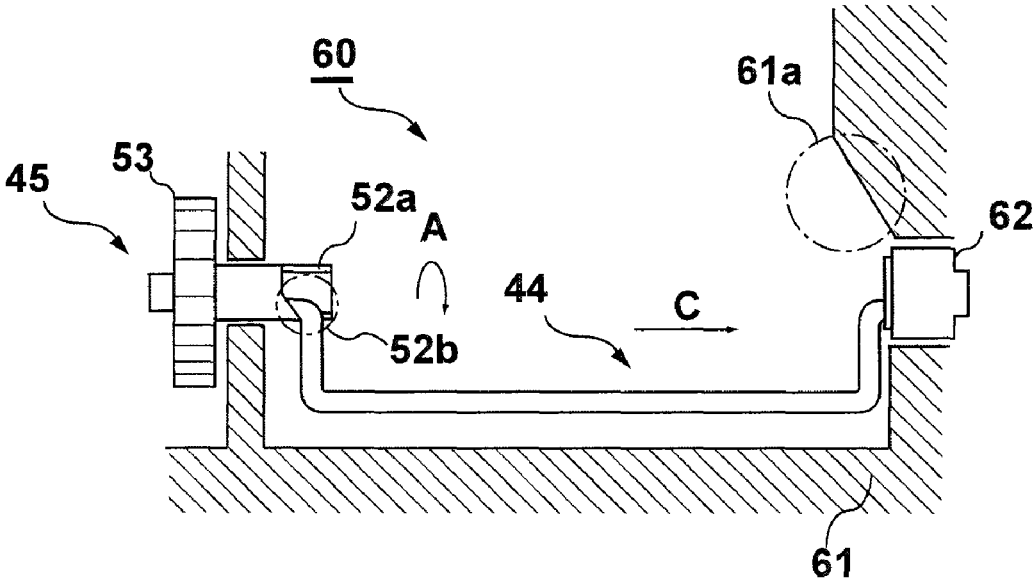
FIG. 12B is a second cross-sectional diagram showing a main structure of toner stirring unit in embodiment 2 of the present invention.

FIG. 12A is a first cross-sectional diagram showing a main structure of toner stirring unit in embodiment 2 of the present invention; and FIG. 12B is a second cross-sectional diagram showing a main structure of toner stirring unit in embodiment 2 of the present invention.

FIG. 12A shows that a stirring portion 44*c* of a stirring bar 44 locates in an upper dead point position in a toner stirring unit 60; and FIG. 12B shows that a stirring portion 44*c* of a stirring bar 44 locates in a lower dead point position in a toner stirring unit 60.

A toner stirring unit 60 of the embodiment is different from embodiment 1 to furnish a slant portion 61*a* on a toner hopper 61.

Moreover, in the embodiment, regarding the same component as that in embodiment 1, it is set to have the same symbol, and its detail explanation is omitted.

In the toner stirring unit 60, on side wall portion of the toner hopper 61, bearing member 62 and bearing drive member 45 to support the stirring bar 44 to possibly rotate, are furnished respectively.

The bearing member 62 is fixed on the side wall portion of the toner hopper 61, and shaft portion 44*a*' of the stirring bar 44 is inserted into an open end of the bearing member 62 as shown by FIGS. 12A and 12B. An inner diameter of the open end of the bearing member 62 is set to be bigger than an outer diameter of the shaft portion 44*a*' in order to possibly move the stirring bar 44 along a rotation axis direction.

Further, on the open end, as shown by FIGS. 12A and 12B, a slant portion 61*a* is furnished as a bearing slant portion. On the basis of the shape of the slant portion 61*a*, the stirring bar 44 is regulated about a position in the rotation axis direction.

Regarding stirring operation of the toner stirring unit 60 in the embodiment, it is similar to embodiment 1.

In the case that remainder amount of toner in the toner hopper 61 is little, the stirring bar 44, after being driven to rotate to an upper dead point position by a bearing drive member 45, drops toward the lower dead point position due to deadweight. Then, once the orthogonal portion 44*b* contacts with the bearing drive member 45, the stirring bar 44 smoothly drops along the slant portion 61*a* while moving along a direction of an arrow C in FIG. 12B; and the shaft portion 44*a* collides with the contact portion 52*c* of the bearing drive member 45 and stops operating. In the case, because such occurrence of rebound or vibration is inhibited, so it is possible to correctly judge the remainder amount of toner.

Moreover, when the stirring bar 44 is driven to rotate to an upper dead point position by the bearing drive member 45, once the orthogonal portion 44*b*' contacts with the slant portion 61*a* of the toner hopper 61, the stirring bar 44 rises while moving along a direction of an arrow D (FIG. 12A) in the contact state, on the basis of the shape of the slant portion 61*a*.

As stated above, in the toner stirring unit of the embodiment, by comparison with embodiment 1, instead of the slant portion furnished on the bearing member, through furnishing such slant portion on the toner hopper, it is possible to obtain the same effect as that in the embodiment 1. Therefore, it is possible to inhibit chattering phenomenon from happening. As a result, it is possible to correctly judge remainder amount of toner.

Embodiment 3

Figure 13:
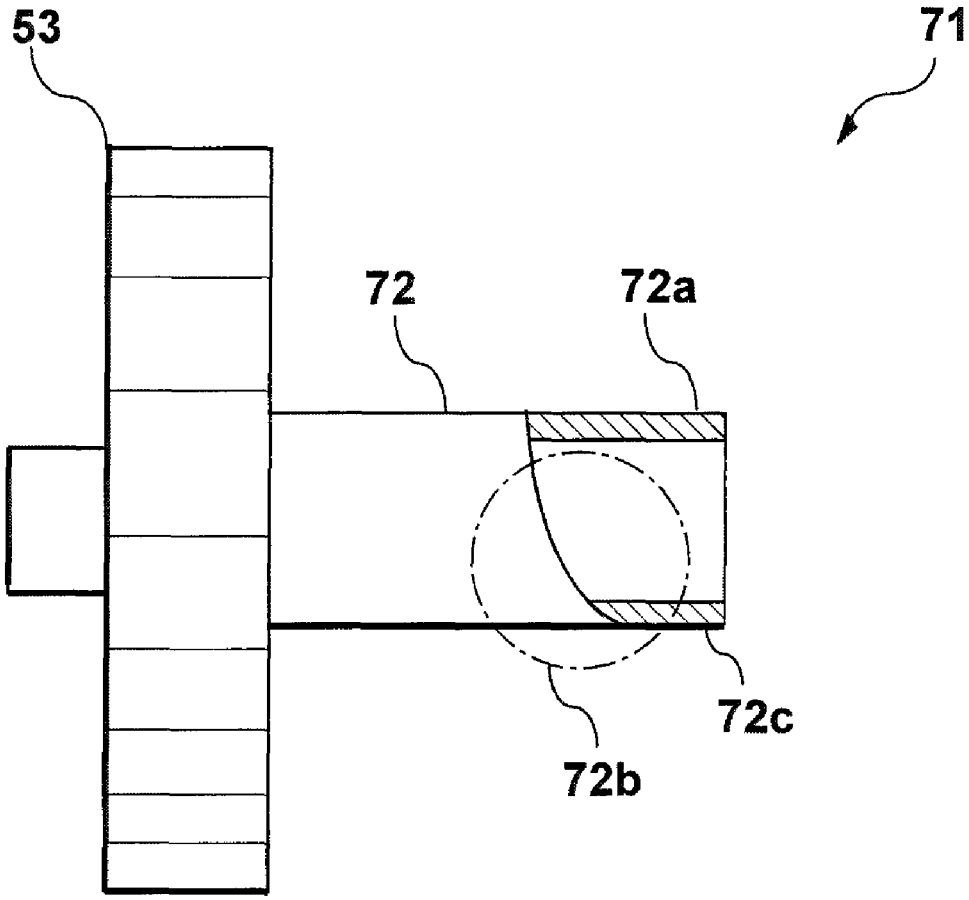
FIG. 13 is a cross-sectional diagram showing a structure of bearing drive member in embodiment 3.

FIG. 13 is a cross-sectional diagram showing a structure of bearing drive member in embodiment 3.

In the toner stirring unit of the embodiment, the shape of a slant portion 72*b* furnished on cylindrical portion 72 of bearing drive member 71 is different from that in embodiment 1.

Moreover, in the embodiment, regarding the same component as that in embodiment 1, it is set to have the same symbol, and its detail explanation is omitted.

In the toner stirring unit of the embodiment, the bearing drive member 71, as bearing member and driving section, has a cylindrical portion 72, and a stirring gear 53 coupled with the cylindrical portion 72.

The cylindrical portion 72 of the bearing drive member 71, as shown by FIG. 13, has a broken part formed on its open end. On the broken part, a drive portion 72*a*, a slant portion 72*b* and a contact portion 72*c* are formed.

In the bearing drive member 45 of embodiment 1, the slant portion 52*b* is formed by cutting the cylindrical portion 52 in straight line shape. However, in the embodiment, in the bearing drive member 71 of the embodiment, as shown by FIG. 13, the slant portion 72*b* is formed by cutting the cylindrical portion 72 in an arc shape.

Regarding stirring operation of the toner stirring unit in the embodiment, it is similar to embodiment 1.

In the case that remainder amount of toner 42 in the toner hopper 43 is little, the stirring bar 44, after being driven to rotate to an upper dead point position by a bearing drive member 71, drops toward the lower dead point position due to deadweight. Then, in a state that the orthogonal portion 44*b* contacts with the bearing drive member 71, the stirring bar 44 smoothly drops along the slant portion 61*a* while moving along a rotation axis direction; and the shaft portion 44*a* collides with the contact portion 72*c* of the bearing drive member 71 and stops operating. During dropping, because the stirring bar 44 can further smoothly drop on the basis of the shape of the slant portion 72*b*, so it is possible to further inhibit rebound or vibration of the stirring bar 44 from occurring.

As stated above, in the toner stirring unit of the embodiment, through forming the slant portion of bearing drive member into arc shape, it is possible to further inhibit chattering phenomenon from happening. As a result, it is possible to further correctly judge remainder amount of toner.

Embodiment 4

Figure 14:
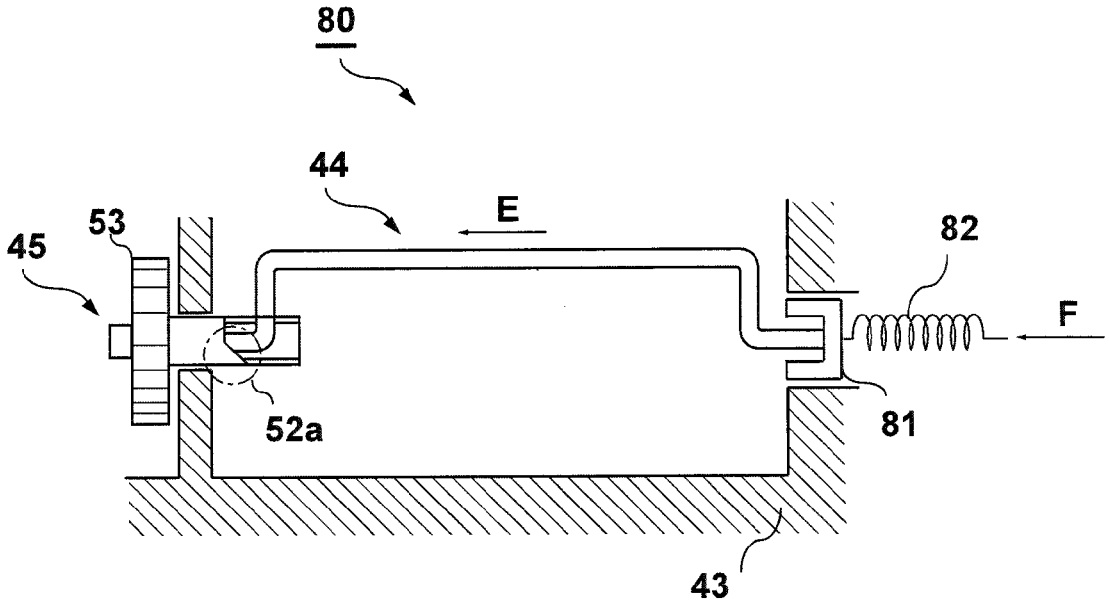
FIG. 14 is a cross-sectional diagram showing a main structure of toner stirring unit in embodiment 4 of the present invention.

FIG. 14 is a cross-sectional diagram showing a main structure of toner stirring unit in embodiment 4 of the present invention.

In a toner stirring unit 80 of the embodiment, a structure is different from embodiment 1 to form a spring 82 supplying elastic force to bearing member 81.

Moreover, in the embodiment, regarding the same component as that in embodiment 1, it is set to have the same symbol, and its detail explanation is omitted.

In the toner stirring unit 80 of the embodiment, on side wall portion of a toner hopper 83, bearing member 81 and bearing drive member 45 to support the stirring bar 44 to possibly rotate, are furnished respectively.

The bearing member 81 is placed on the side wall portion of the toner hopper 83, and shaft portion 44*a*' of the stirring bar 44 is supported to rotate possibly.

In the bearing member 81, as shown by FIG. 14, the spring 82, as force supplying member, is placed on the back side of a support plane to support the stirring bar 44. The spring 82 is furnished in a shrinking state in comparison with nature length, so that its one end is fixed on the bearing member 81, and its other end is fixed on inner plane of the toner hopper 83. Then, the spring 82 always supplies elastic force to the bearing member 81 and the stirring bar 44 supported by the bearing member 81 along a direction of an arrow F i.e. rotation axis direction.

Regarding stirring operation of the toner stirring unit 80 in the embodiment, it is similar to embodiment 1.

The stirring bar 44 rotates while its position is regulated in the rotation axis direction on the basis of the elastic force supplied by the bearing member 81 via the bearing member 81 and on the basis of the shape of the bearing drive member 45. Then, because the stirring bar 44 smoothly drops due to deadweight along the slant portion 52*b* of the bearing drive member 45, when the stirring bar 44 collides with the contact portion 52*c*, such occurrence of rebound or vibration is inhibited.

As stated above, in the toner stirring unit of the embodiment, through furnishing bearing member to move possibly along rotation axis direction and furnishing a spring to supply elastic force to the stirring bar via the bearing member, it is possible to inhibit chattering phenomenon from happening. As a result, it is possible to correctly judge remainder amount of toner.

Embodiment 5

Figure 15:
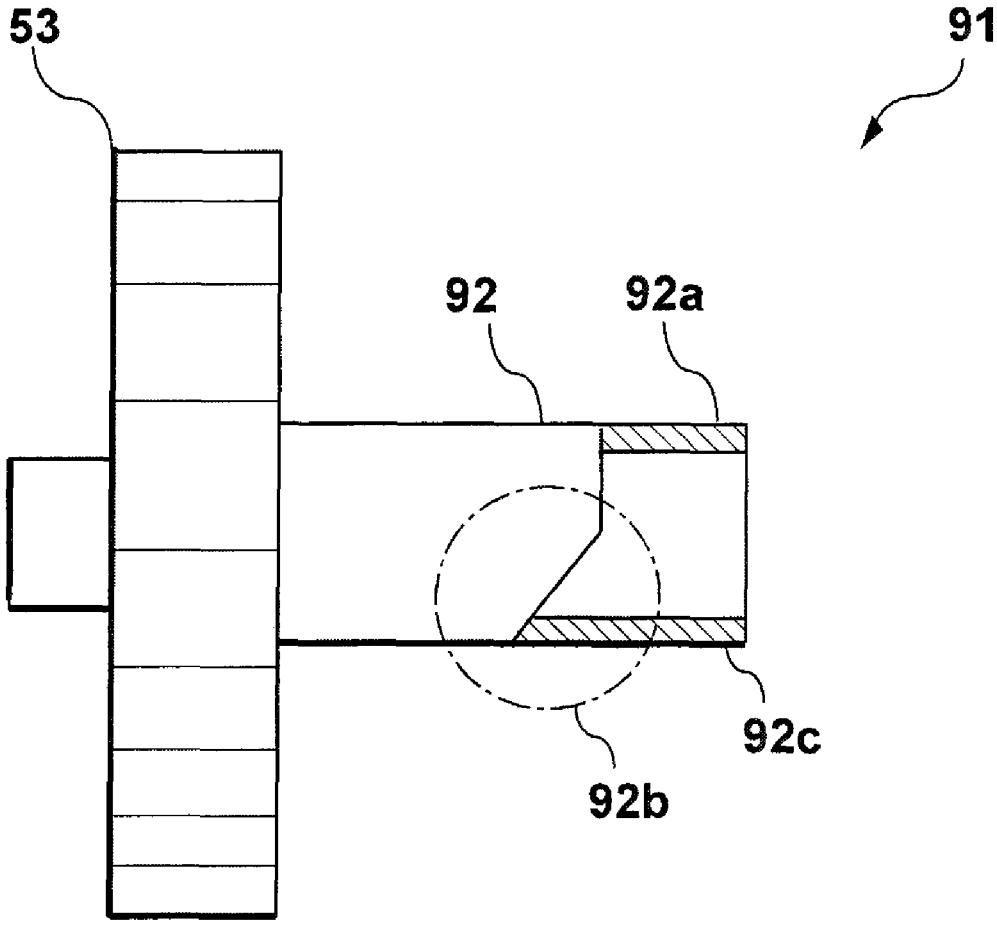
FIG. 15 is a cross-sectional diagram showing a structure of bearing drive member in embodiment 5.

FIG. 15 is a cross-sectional diagram showing a structure of bearing drive member in embodiment 5.

The toner stirring unit of the embodiment has a similar structure to the toner stirring unit 80 of embodiment 4, but the shape of a slant portion 92*b* of a cylindrical portion 92 of bearing drive member 91 is different from that in embodiment 4.

Moreover, in the embodiment, regarding the same component as that in embodiment 4, it is set to have the same symbol, and its detail explanation is omitted.

In the toner stirring unit of the embodiment, the bearing drive member 91, as bearing member and driving section, has a cylindrical portion 92, and a stirring gear 53 coupled with the cylindrical portion 92.

The cylindrical portion 92 of the bearing drive member 91, as shown by FIG. 15, has a drive portion 92*a*, a slant portion 92*b* and a contact portion 92*c*.

In the bearing drive member 45 of embodiments 1 and 4, the slant portion 52*b* is formed by cutting the cylindrical portion 52 from an approximate center portion toward open end. However, in the embodiment, in the bearing drive member 91 of the embodiment, as shown by FIG. 15, the slant portion 92*b* is formed by cutting the cylindrical portion 92 from an approximate center portion toward a coupling part with the stirring gear 53.

Regarding stirring operation of the toner stirring unit in the embodiment, it is similar to embodiment 4.

The stirring bar 44 rotates while its position is regulated in the rotation axis direction, after passed through the upper dead point position, then, smoothly drops due to deadweight along the slant portion 92*b* of the bearing drive member 91. Therefore, when the stirring bar 44 collides with the contact portion 92*c*, such occurrence of rebound or vibration is inhibited.

As stated above, in the toner stirring unit of the embodiment, through changing the shape of the slant portion of the bearing drive member together with supplying elastic force to the stirring bar, it is possible to obtain the same effect as the embodiment 4. As a result, it is possible to correctly judge remainder amount of toner.

The Utilization Possibility in Industry

In respective embodiments of the present invention, the bearing drive member, as bearing member, includes a slant portion that, as bearing slant portion, has a slant with respect to a direction of rotation axis, on a contact portion with stirring bar serving as stirring member; and the stirring bar moves along an axis direction of rotation axis together with rotating along rotation direction of rotation axis. However, the present invention is not limited in these embodiments.

Further, in the above stated explanation, only such case is explained that the present invention is applied to a printer as an image forming apparatus on which a developing device having a toner stirring unit is installed. However, the present invention is not limited in this case. The present invention also can be applied to various devices such as monochrome printer, copying apparatus, facsimile apparatus, multiplex apparatus having two functions or over and the like.

The present invention is not limited to the foregoing embodiments but many modifications and variations are possible within the spirit and scope of the appended claims of the invention.

What is claimed is:

1. A developer stirring unit comprising:

an accommodating tank that accommodates developer;

a stirring member for stirring the developer, the stirring member having at least one shaft portion;

a bearing member that includes:

a slant portion having a slant with respect to a rotational axis of the at least one shaft portion, and a contact portion that contacts the stirring member;

a driving section that rotates the stirring member; and a judging section that judges a remainder amount of the developer in the accommodating tank, wherein the bearing member is coupled to the shaft portion to support the stirring member, rotate the stirring member about the rotational axis, and move the stirring member along an axis direction of the rotational axis.

2. The developer stirring unit according to claim 1, wherein the judging section has a position detecting portion to detect a position of the stirring member at a predetermined timing, and performs a judgment of the remainder amount on the basis of the position.

3. The developer stirring unit according to claim 1, wherein the driving section is furnished on an end of the bearing member and presses the shaft portion to drive the shaft portion.

4. The developer stirring unit according to claim 1, further comprising: a force supplying section that supplies elastic force to the stirring member toward the axis direction.

5. The developer stirring unit according to claim 1, wherein the slant is arc shaped.

6. The developer stirring unit according to claim 1, wherein the accommodating tank has a regulating section to regulate movement of the stirring member in the axis direction.

7. The developer stirring unit according to claim 6, wherein the regulating section is a side wall slant section formed on a side wall portion of the accommodating tank.

8. A developing device comprising;

a developer stirring unit that includes:

an accommodating tank that accommodates developer;

a stirring member for stirring the developer, the stirring member having at least one shaft portion;

a bearing member that includes:

a slant portion having a slant with respect to a rotational axis of the at least one shaft portion, and a contact portion that contacts the stirring member;

a driving section that rotates the stirring member; and a judging section that judges a remainder amount of the developer in the accommodating tank, wherein the bearing member is coupled to the shaft portion to support the stirring member, rotate the stirring member about the rotational axis, and move the stirring member along an axis direction of the rotational axis.

9. The developing device according to claim 8, wherein the judging section has a position detecting portion to detect a position of the stirring member at a predetermined timing, and performs a judgment of the remainder amount on the basis of the position.

10. The developing device according to claim 8,wherein the driving section is furnished on an end of the bearing member and presses the shaft portion to drive the shaft portion.

11. The developing device according to claim 8, wherein the developer stirring unit further includes a force supplying section that supplies elastic force to the stirring member toward the axis direction.

12. The developing device according to claim 8, wherein the slant is arc shaped.

13. The developing device according to claim 8, wherein the accommodating tank has a regulating section to regulate movement of the stirring member in the axis direction.

14. The developing device according to claim 13, wherein the regulating section is a side wall slant section formed on a side wall portion of the accommodating tank.

15. An image forming apparatus comprising;

a developing device that includes a developer stirring unit having:

an accommodating tank that accommodates developer;

a stirring member for stirring the developer, the stirring member having at least one shaft portion;

a bearing member that includes:

a slant portion having a slant with respect to a rotational axis of the at least one shaft portion, and a contact portion that contacts the stirring member;

a driving section that rotates the stirring member; and a judging section that judges a remainder amount of the developer in the accommodating tank, wherein the bearing member is coupled to the shaft portion to support the stirring member, rotate the stirring member about the rotational axis, and move the stirring member along an axis direction of the rotational axis.

16. The image forming apparatus according to claim 15, wherein the judging section has a position detecting portion to detect a position of the stirring member at a predetermined timing, and performs a judgment of the remainder amount on the basis of the position.

17. The image forming apparatus according to claim 15, wherein the driving section is furnished on an end of the bearing member and presses the shaft portion to drive the shaft portion.

18. The image forming apparatus according to claim 15, wherein the developer stirring unit further includes a force supplying section that supplies elastic force to the stirring member toward the axis direction.

19. The image forming apparatus according to claim 15 wherein the slant is arc shaped.

20. The image forming apparatus according to claim 15, wherein the accommodating tank has a regulating section to regulate movement of the stirring member in the axis direction.

21. The image forming apparatus according to claim 20, wherein the regulating section is a side wall slant section formed on a side wall portion of the accommodating tank.

* * * * *